United States Patent [19]

Kuemmerling et al.

[11] Patent Number: 4,803,861

[45] Date of Patent: Feb. 14, 1989

[54] GUIDE STRUCTURE FOR PIERCED HOLLOWS

[75] Inventors: Rolf Kuemmerling, Duisburg; Manfred Mueller, Duesseldorf; Klaus-Peter Schirmag, Ratingen; Wilhelm Nickel, Mulheim, all of Fed. Rep. of Germany

[73] Assignee: Mannesmann AG, Duesseldorf, Fed. Rep. of Germany

[21] Appl. No.: 3,830

[22] Filed: Jan. 16, 1987

[30] Foreign Application Priority Data

Jan. 23, 1986 [DE] Fed. Rep. of Germany ..... 3602176

[51] Int. Cl.[4] ..... B21B 19/04

[52] U.S. Cl. ..... 72/97

[58] Field of Search ..... 72/95, 96, 97

[56] References Cited

U.S. PATENT DOCUMENTS

| | | | |
|---|---|---|---|
| 2,011,802 | 8/1935 | Diescher | 72/96 |
| 2,025,148 | 12/1935 | Bannister | 72/97 |
| 2,141,130 | 12/1938 | Findlater | 72/97 |
| 2,309,690 | 2/1943 | Aiken | 72/97 |

FOREIGN PATENT DOCUMENTS

| | | | |
|---|---|---|---|
| 428797 | 5/1974 | U.S.S.R. | 72/96 |

*Primary Examiner*—Lowell A. Larson

*Attorney, Agent, or Firm*—Ralf H. Siegemund

[57] ABSTRACT

A pierced hollow rolled by obliquely positioned conical or barrel-shaped rolls, is held against excessive ovality by driven guide sheaves or disks acting in combination with guide bars downstream for controlling the rate of radial widening of the hollow. Oblique positions of the axes of the disks permits them to be of larger diameter.

4 Claims, 3 Drawing Sheets

GUIDE STRUCTURE FOR PIERCED HOLLOWS

BACKGROUND OF THE INVENTION

The present invention relates to a rolling mill in which conical rolls are arranged with axes that are inclined in relation to each other and cooperating with a piercing mandrel establishing a rolling gap therewith for forming tubular stock out of solid billets, with a declining wall thickness and increasing diameter in the direction of rolling and under utilization of disks or sheaves for guiding the rolling stock in front of or in a plane transverse to the axes of rolling which runs through points of minimum distance between the rolls, which disks have axes parallel to that plane.

German printed patent application No. 21 56 595 discloses a rolling mill with obliquely positioned rolls of the type referred to above and including specifically such guide disks which project through two lateral windows in rolling stand and reach into the working range of the rolls. In lieu of such driven guide disks one can use guide bars which are adjustable by means of levers and transversely to the direction of rolling. Such a guide structure is for example disclosed in "Stahl und Eisen" 53, 19, pages 465–470.

German Pat. No. 641 375 suggests the utilization of rolls or bars in a rolling mill with oblique rolls to be placed between these rolls and as an alternative for piercing or stretch reducing. In a later development, piercing is carried through so called Diescher disks with axes of rotation transverse to the axes of rolling. These disks are usually driven at a peripheral speed which exceeds the longitudinal speed of the rolled stock.

If a solid billet is pierced in a rolling mill with oblique rolls then special requirements arise for guiding the rolled stock. Particularly if drastic widening occurs to a diameter having a 1.5-fold value of the original billet. Rolling mill constructions proposed for this purpose are shown in German Pat. Nos. 418 002 or 505 250 using conical rolls.

DESCRIPTION OF THE INVENTION

It is an object of the present invention to provide a new and improved arrangement which includes obliquely oriented rolling mills and a piercing mandrel as well as guide structures for the rolling stock using particularly small guide disks for the production of a high degree of ovality so as to be able to provide a widening of the hollow in the smoothing stage of the mill.

In accordance with the preferred embodiment of the present invention it is suggested to provide guide bars, in addition to the guide rolls, and downstream from the plane that runs through the closest points the rolls have in relation to each other, the bars are to be inserted in the space between the rolled stock and the guide disks for controlling the rate of radial widening of the emerging hollow and in direction of rolling. The axes of the guide disks are preferably inclined towards a central plane of the frame in the same direction by not more than about 20 degrees.

It was found that relatively large ovalities can be obtained upon using the invention specifically for small guide disk diameter, owing to these additional guide bars. The invention is based on the discovery, followed up by practical consideration, that for piercing and stretching of billets and hollows it is more important to guide the rolled stock than to provide different rolls for different tasks.

One can expect that the disk undergoes little wear during piercing, and the guide rods being arranged downstream from these disks, can be matched accurately to the contour of the hollow that is being formed. These rods establish a high degree of shape stability of the hollow product even if the resulting tubes have relatively thin walls.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a rolling mill stand operating with and having an axis of rolling 1 being indicated by a dash dot axial line. The rolling stock is arranged coaxially thereto; in the left of the drawing a solid round billet 2 is shown which is deformed through a piercing operation in the stand and emerges towards the right as a hollow 3. The hollow may be a tube having as its final dimensions a wall thickness of about 1/35 of the outer diameter of the hollow 3. That diameter exceeds actually the 1.5 value of the diameter of the solid billet 2.

Figure 1:
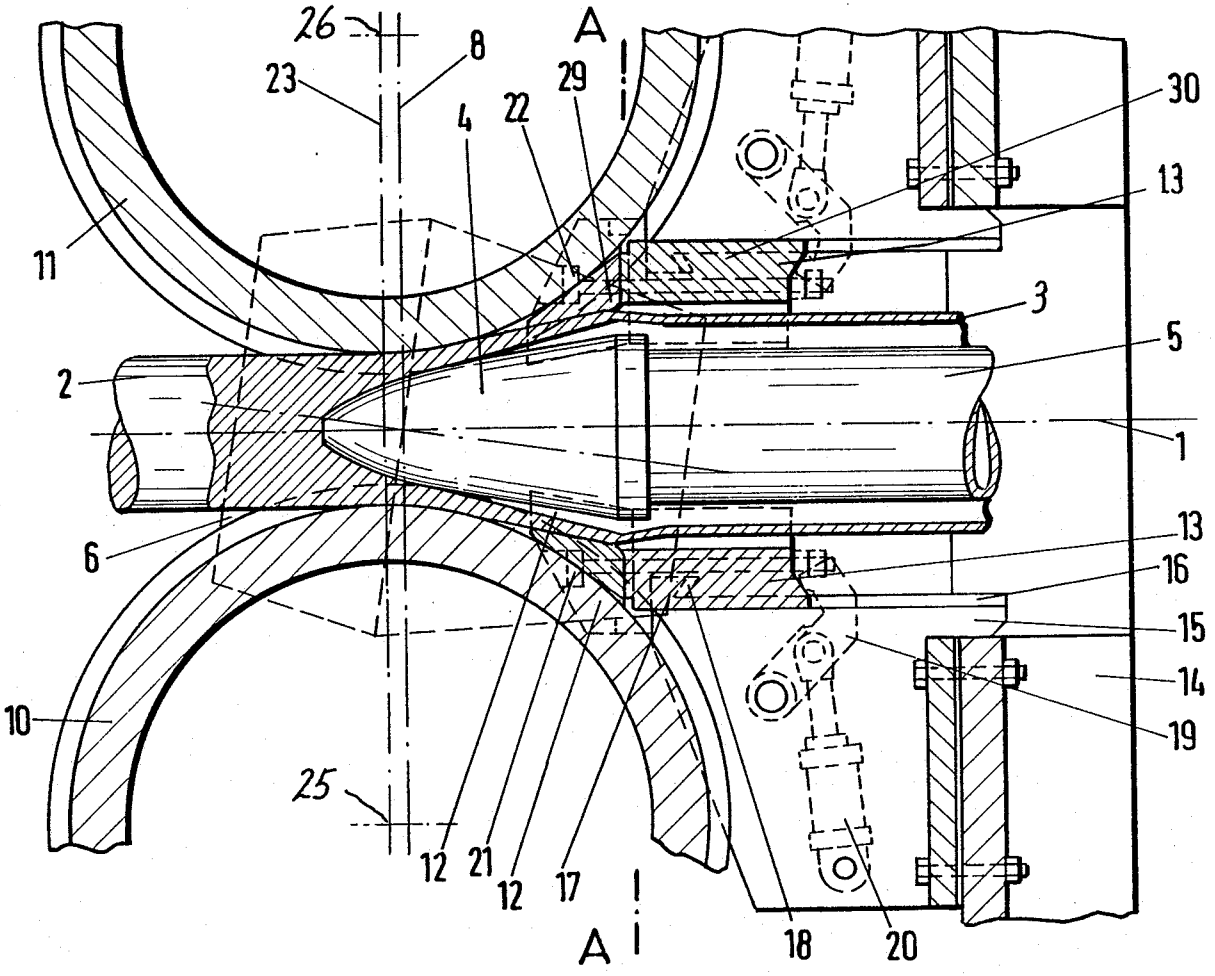
FIG. 1 is a longitudinal section view in a rolling mill stand, the section being specifically taken through the disks and guide rods constructed and provided in accordance with the preferred embodiment of the present invention for practicing the best mode thereof.

A piercing mandrel 4 is mounted on a mandrel rod 5 and projects into the rolled stock 2–3. The mandrel can be rotated conventionally. During rolling the solid stock 2 moves in the drawing to the right and over the piercing mandrel 4 and as a hollow 3 around the mandrel rod 5. The resulting hollow will be stripped off the mandrel after completion of rolling, by retracting the mandrel rod from the rolling mill and particularly the rolling gap. The resulting hollow may have a length of 240 or even 360 mm.

Figure 2:
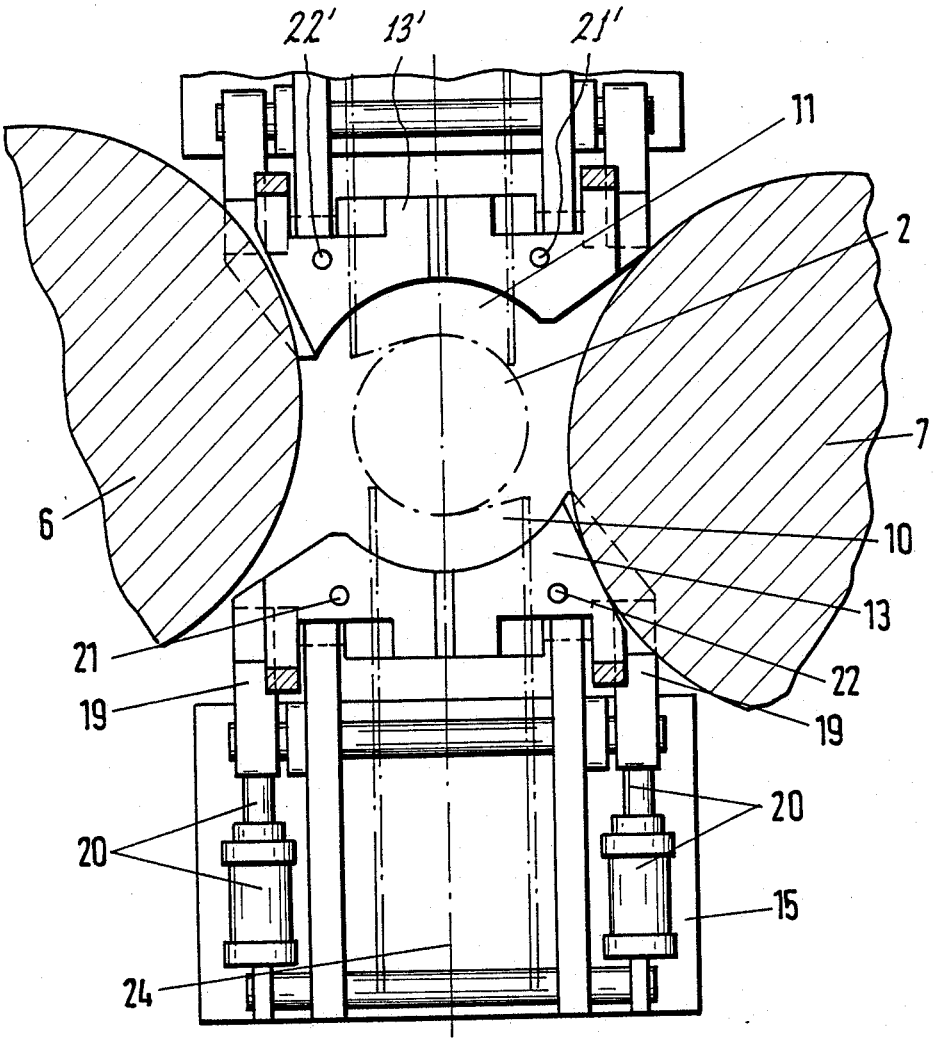
FIG. 2 is a cross section taken through A—A in FIG. 1 at the end of the rolls, whereby the rolls are shown as placed in guides which are arranged at the proper angle in relation to each other.

The rolling mill stand includes two double cone rolls 6 and 7 which, as can be seen best from FIG. 2, face each other across the rolling gap 11. Roll 6 is shown in phantom lines in FIG. 1. The rolls are basically oriented and disposed in a horizontal orientation. These rolls, which can also be termed barrel-shaped rolls, have axes which are inclined relative to each other. The rolls establish a helical motion of the rolling stock 2–3, in the direction of the axis 1 of rolling and towards the right in FIG. 1. The peripheries of the two rolls have a minimum distance from each other which establishes a plane 8. Guide disks 10 and 11, also termed Diescher disks, are arranged upstream from the plane 8 and are spaced from the rolls 6 and 7 by being, respectively, below and above the rolling stock 2–3. These disks 10, 11, have axes of rotation 25 and 26, respectively; the disks are normally driven.

As seen in the direction of rolling and downstream from plane 8 a stationary guide structure is provided which is comprised of two wear and replacement part 12, 29, each with a holder 13, 30, respectively. The two parts 12 and 13 are interconnected by means of bolts 21 and 22 and parts 29, 30 are analogously interconnected by bolts 21' and 22'. The parts 12 and 29 will be exchanged for purposes of replacement. Basically it is not advantageous to make parts 12 and 13 (29, 30) of uniform or unitary structure simply because the use life of parts 13, and 30, is longer than of parts 12 and 29. Even though it is better to replace the two parts together, later on parts 13 and 30 can still be used by bolting new parts 12 and 29 to them.

The parts 12 and 13 (29, 30) "fill" the space or gap between rolled stock 2–3 right when it has become a hollow and the, so to speak, periphery of the disks 10,11. That periphery recedes from the line of rolling with distance from the plane 8. The parts 12 and 29 are still placed in the general area of rolls 6 and 7 and restrict the rate of radial widening of the hollow. The function of these bars 12 and 29 generally is to prevent the rather thin walled hollow to assume too wide an ovality.

The stationary holding structure for the parts 12 and 13 is further comprised of a mounting element 15 with a slide surface plate 16 and a stop 17. This mounting device 15 is fastened to the frame or rolling stand 14. In order to adjust the parts 12 and 13 in the direction of rolling one needs shims or inserts 18. In addition positive engagement is provided for purposes of fastening under utilization of an angle lever 19 being driven by a hydraulic or pneumatic drive 20. The analogous arrangement for the structure 29 and 30 is shown in the upper part of FIG. 1 without utilization of reference numerals the symmetry and correspondence of parts is readily derivable from the figures themselves.

Figure 3:
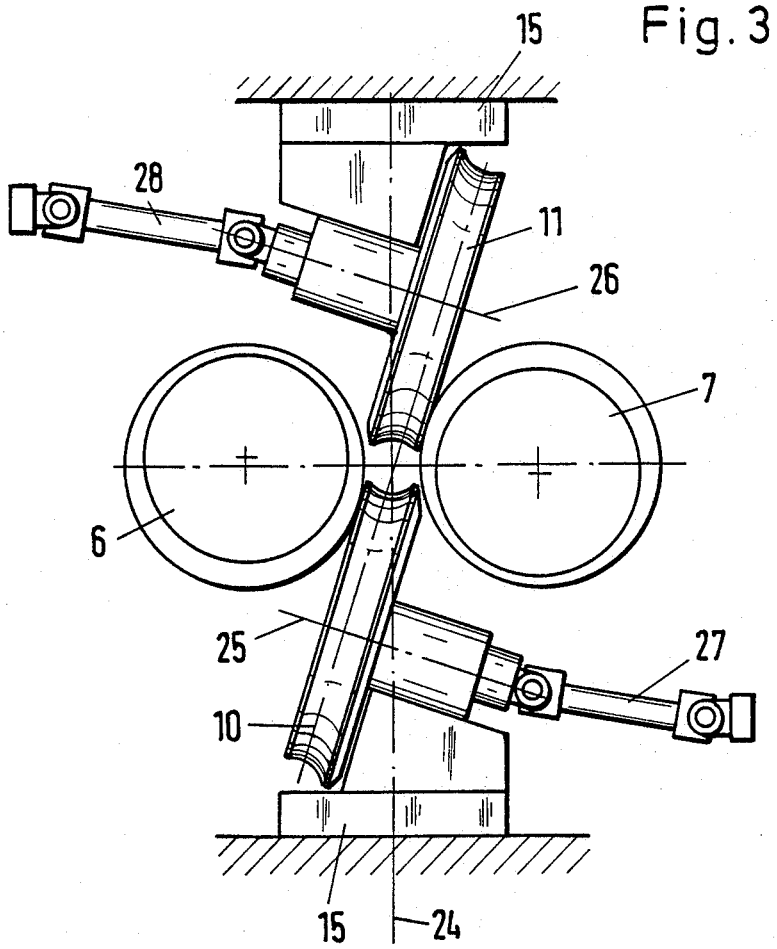
FIG. 3 illustrates in a smaller scale and for a different example, a cross section through a plane parallel to the A—A plane in FIG. 2, the section plane being indicated by 23 in FIG. 1.

As per FIG. 3 the plane of illustration coincides with the plane 23 in FIG. 1 in which are situated the axes 25 and 26, respectively, of the disks 10 and 11. Rolls 6 and 7, disks 10, 11 and mounting structures 15 for the guide bars are also shown here. However the disks 10, 11 are somewhat differently arranged in relation to the center plane 24 of the stand. The center plane 24 is shown in FIG. 2 as well as in FIG. 3. Plane 24 extends particularly transversely to the respective plane of the drawings of FIGS. 2 and 3. However, in FIG. 3, the axes 25 and 26 of the disks 10 and 11 run at an angle of about 15 degrees to that plane 24. As stated earlier an angle of inclination of about 20 degrees should not be exceeded. In FIG. 2 there is a zero degrees inclination.

The diameters of the disks 10 and 11 are determined by agents in the diameter of the rolls 6 and 7. Further parameters to be considered are the space requirements for bearings and drive structures including for example articulated shafts 27 and 28 (FIG. 3 for the disks 10 and 11. Basically one wants to use as small guide disks as possible, particularly in these cases in which the diameter of the stock to be rolled increases significantly. The shown example is illustrative of this aspect. Any large diameter for the guide disks behind the plane 23 would provide an undesired narrowing of the space and i.e. the space available for widening of the stock; as seen in the direction of rolling a more gradual receding of the guide disks of large diameter from the stock narrows the gap between the stock and the guide disks; this is to be avoided. The invention is instrumental in offsetting the disadvantage of small guide disks through the particular arrangement of inclined disks whose diameter is about 50% of the diameter that occupies the space of normal standing guide disks. In other words, owing to the oblique axes of the guide disks 10 and 11, these disks, so to speak, move out of the way of the widening hollow earlier than without oblique axis position which means that these disks can be made larger, all other conditions remaining the same.

The invention is not limited to the embodiments described above, but all changes and modifications thereof, not constituting departures from the spirit and scope of the invention are intended to be included.

We claim:

1. In a rolling stand for piercing using barrel-shaped or conical rolls arranged with inclined axes in relation to each other, further including a mandrel or a mandrel rod, a guide structure comprising in combination:

driven guide disks having axes both being arranged in a first plane (23) being in or upstream from a second plane 8 said second plane running through points of closest distance of the rolls and establishing therewith a guided space for widening of pierced stock; and guide bars arranged downstream from said planes in space between said disks and the rolled stock, for controlling widening of a hollow that has been pierced by the mandrel in combination with the rolls.

2. The combination as in claim 1 wherein the axes of said disks are inclined in the same direction by not more than 20 degrees in relation to a vertical center plane of the rolling stand running through an axis of rolling.

3. The combination as in claim 1, including means for adjusting a position of the guide bars relative to an axis of rolling.

4. The combination as in claim 1, wherein each guide bar includes a holder and a wedge-like element bolted to the holder.

* * * * *